US005285996A

United States Patent [19]

Waller

[11] Patent Number: 5,285,996

[45] Date of Patent: Feb. 15, 1994

[54] LOWER RIM GUARD FOR METAL CANS

[76] Inventor: David C. Waller, 7655 NW. 42nd Pl., No. 265, Sunrise, Fla. 33351

[21] Appl. No.: 874,083

[22] Filed: Apr. 27, 1992

[51] Int. Cl.[5] ..... F16M 13/00

[52] U.S. Cl. ..... 248/687; 248/346.1; 220/701

[58] Field of Search ..... 248/346.1, 345.1, 687; 220/700, 701, 730, 733, 737; 215/100 R, 100.5

[56] References Cited

U.S. PATENT DOCUMENTS

| | | | |
|---|---|---|---|
| 1,452,035 | 4/1923 | Freeman | 248/687 X |
| 2,148,055 | 2/1939 | Blumenthal | 248/687 X |
| 2,461,968 | 2/1949 | Derham | 248/687 |
| 2,683,579 | 7/1954 | Wallace | 248/687 X |
| 3,327,893 | 6/1967 | Graves | 248/345.1 X |
| 3,358,725 | 12/1967 | Bussard et al. | 248/345.1 X |
| 3,393,933 | 7/1968 | Cornelius | 248/345.1 |
| 3,419,240 | 12/1968 | Santic | 248/687 X |

*Primary Examiner*—David L. Talbott
*Attorney, Agent, or Firm*—Frank L. Kubler

[57] ABSTRACT

An apparatus for covering the lower rim of a metal can, where the rim has an outer face and an inner face and a bottom edge, includes a channel member having first and second side wall portions and a bottom wall portion connecting the first and second side wall portions, for fitting over the lower rim, such that the first side wall portion substantially covers the outer face, and the second side wall portion substantially covers the inner face, and the bottom wall portion substantially covers the bottom edge. The first side wall portion preferably has an inner first side wall surface, additionally including a lip portion extending from the inner first side wall surface toward the second side wall portion, for resiliently snapping over the rim and contracting above the rim to help hold the channel member securely on the can. Where the can has a can wall, the first side wall portion of the channel member optionally extends upward along the can wall above the rim for providing a surface for displaying a message. The channel member is preferably formed into a continuous loop having a shape essentially matching that of the rim. Alternatively, the channel member is a flexible strip which can be cut and laterally bent to fit a variety of can rims.

9 Claims, 2 Drawing Sheets

LOWER RIM GUARD FOR METAL CANS

BACKGROUND OF THE INVENTION

1. Field of the Invention

The present invention relates generally to the field of holders for glasses and cans, and more specifically to a stiff and resilient channel member for snapping over the rim protruding from the bottom of a metal can, such as an aerosol can, which covers the entire rim including the inner and outer rim faces, to prevent the rim from scratching or leaving rust deposits on the surface supporting the can, such a shelf, counter or table.

2. Description of the Prior Art

There have long been holders for vessels such as metal cans to prevent damage to furniture from scratching and from accumulations of condensate. These holders have generally been disks with raised edges for serving as coasters or rugged shells for protecting a vessel against impact damage.

One such prior holder is that of McKee, U.S. Pat. No. 4,829,618, issued on May 16, 1989. McKee teaches a coaster having a square body with parallel top and bottom surfaces and a circular depression in the top surface for receiving the bottom of a can or glass. McKee also includes a slot for engaging the tab on a can and a circular depression for gripping bottle caps. A problem with McKee is that it would be relatively expensive to make and must be available wherever one happens to decide to set down a can. If one were to walk around a house carrying a soft drink can, for example, one would have to separately carry a McKee coaster as well, or be inconvenienced by having to continuously hold the can. Alternatively, one would have to place McKee coasters in many locations around the house, thereby multiplying expenses.

Good, U.S. Pat. No. 3,809,353, issued on May 7, 1974, discloses a protective cap for fitting over the lower end of a scuba diver's air tank. The cap contains supportive ribs which permit water to pass through the cap. A problem with Good is that manufacturing a smaller version for the bottom of an aerosol or beverage can would be prohibitively expensive. And if made to be a separate coaster, Good would present the inconveniences of McKee.

Lerner, U.S. Pat. No. 2,905,351, issued on Sep. 22, 1959, discloses a snap-on base for a bottle, jar or glass in the form of a hollow, annular member beveled to widen at its lower end. The vessel is provided with a circumferential channel around its base for engagingly receiving the interior, upper edge of the member. A problem with Lerner is that the member is significantly wider than the base of the vessel at its base. If vessels were manufactured and sold with the member, a substantial portion of packaging and retail shelf space would be sacrificed. Also, if Lerner were to support a metal can, moisture could accumulate on the lower rim of the can and drip onto the supporting surface, depositing rust stains. Finally, Lerner would be relatively expensive to manufacture.

Hazel, U.S. Pat. No. 2,893,163, issued on Jul. 7, 1959, teaches a coaster for supporting a vessel such as a can or glass, to protect the surface on which it rests from condensate. Hazel presents a three-layer unitary body, the two outer layers being absorbent and the inner layer being non-absorbent. The inner layer prevents moisture from soaking through to the surface supporting the vessel. Hazel includes a cavity in its upper face containing ribs for supporting the vessel. The problems with Hazel are much the same as those identified for McKee: the coaster must be carried with the user or many such coasters must be provided at various locations. Hazel is not suited for pre-attachment to the vessel during manufacture because it extends the vessel diameter significantly and also greatly increases vessel cost.

Wallace, U.S. Pat. No. 2,683,579, issued on Jul. 13, 1954, teaches a base for supporting cans such as those containing cleansers. The purpose of the base is to prevent the can from falling over and from scratching the surface on which it rests. Wallace presents an annular flange member which includes a radially extending ledge portion and a perpendicular tube portion extending upwardly from the ledge portion inner edge. A groove is provided in the ledge portion near the inner edge so that when the lower rim of a can is inserted into the tube portion, the tube material can deform outwardly into the groove. In this way, Wallace grips the can rim without substantially changing shape. A problem with Wallace is that the projecting ledge portion substantially increases the diameter of the can, causing a shipment of cans thus equipped to occupy much more package and shelf space. Also, if the can and base are resting in a puddle of water on a supporting surface, the water can freely touch the lower can rim and cause the rim to rust and leave rust deposits on the supporting surface. This is because the can is not substantially elevated and there is no protective cover over the inner face of the rim. Also, continually keeping the base material deformed and under tension could shorten the life of the base. Finally, Wallace would be relatively expensive to manufacture and may tend to fall off the can.

It is thus an object of the present invention to provide a rim guard for a metal can which only negligibly extends the diameter of the can rim, so that storage, packing and shelf space are conserved.

It is another object of the present invention to provide such a rim guard which essentially covers the entire lower rim so that the metal remains substantially dry and no rust-carrying liquid can reach the supporting surface.

It is another object of the present invention to provide such a rim guard which returns to its original shape when installed on a rim, so that the guard material does not remain under stress.

It is still another object of the present invention to provide such a rim guard which can be sold with and will stay on the can unless intentionally removed.

It is still another object of the present invention to provide such a rim guard which can be firmly attached to a rim to prevent theft of the guard in retail stores.

It is still another object of the present invention to provide such a rim guard which can be manufactured to extend up the wall of the can and provide advertising space.

It is finally an object of the present invention to provide such a rim guard which is durable, compact and very inexpensive to manufacture.

SUMMARY OF THE INVENTION

The present invention accomplishes the above-stated objectives, as well as others, as may be determined by a fair reading and interpretation of the entire specification.

An apparatus is provided for covering the lower rim of a metal can, the rim having an outer face and an inner face and a bottom edge, including a channel member having first and second side wall portions and a bottom wall portion connecting the first and second side wall portions, for fitting over the lower rim, such that the first side wall portion substantially covers the outer face, and the second side wall portion substantially covers the inner face, and the bottom wall portion substantially covers the bottom edge. The first side wall portion preferably has an inner first side wall surface, additionally including a lip portion extending from the inner first side wall surface toward the second side wall portion, for resiliently snapping over the rim and contracting above the rim to help hold the channel member securely on the can. Where the can has a can wall, the first side wall portion of the channel member optionally extends upward along the can wall above the rim for providing a surface for displaying a message. The bottom wall portion may have a flat lower surface for distributing the weight of the can on a supporting surface. The bottom wall portion alternatively may have a rounded lower surface for providing a concentrated contact area to maximize friction with a supporting surface. The channel member is preferably formed into a continuous loop having a shape essentially matching that of the rim. Alternatively, the channel member is a flexible strip which can be cut and laterally bent to fit a variety of can rims.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
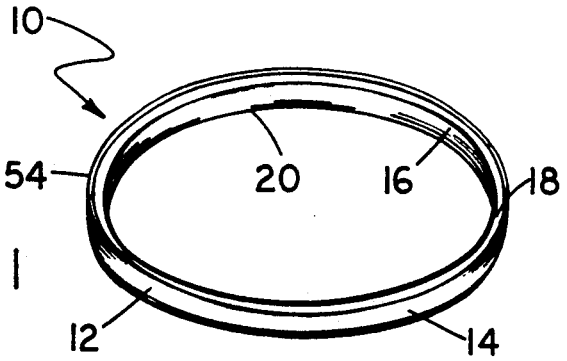
FIG. 1 is a perspective view of the first embodiment of the inventive rim guard apparatus, loop-shaped to fit a circular can rim.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
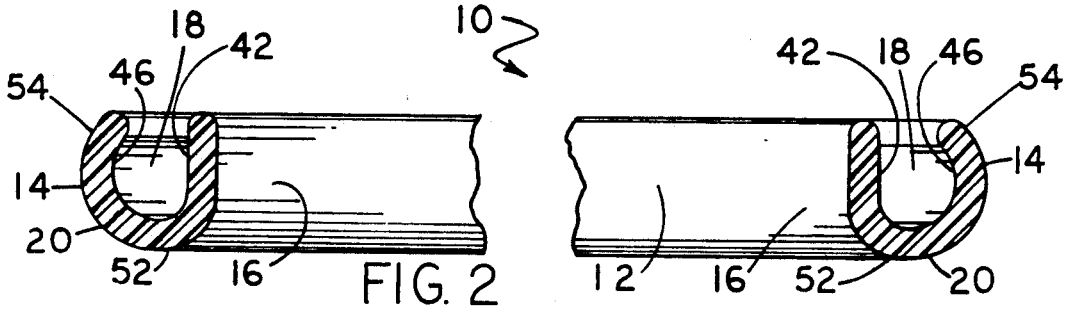
FIG. 2 is a cross-sectional front view of the rim guard of FIG. 1, having a vertically straight inner wall.
Figure 3:
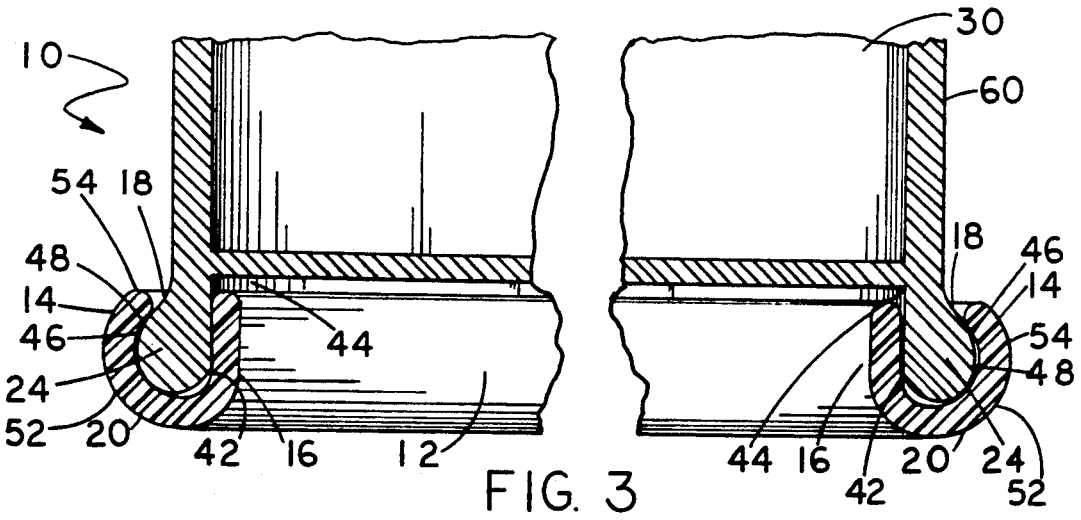
FIG. 3 shows the cross-sectional view of FIG. 2, with a can rim inserted into the rim guard.

Referring to FIGS. 1 and 2, a can rim guard device 10 is disclosed which comprises a channel member 12 having an outer wall 14, an inner wall 16, an open top 18 and a bottom wall 20. The interior surfaces of member 12 are dimensioned to snugly fit around the lower rim 24 of a metal can 30. See FIG. 3.

Member 12 is preferably made of a stiff, resilient, non-rusting material so that it can snap over lower rim 24, and rigidly retain its shape to remain in place during normal use. If applied during manufacture, the fit should be very snug and the stiffness substantial, to prevent shoppers from removing member 12 from a can 30 to take home. Member 12 may be made of any suitable plastic, or other non-rusting materials such as aluminum.

Figure 4:
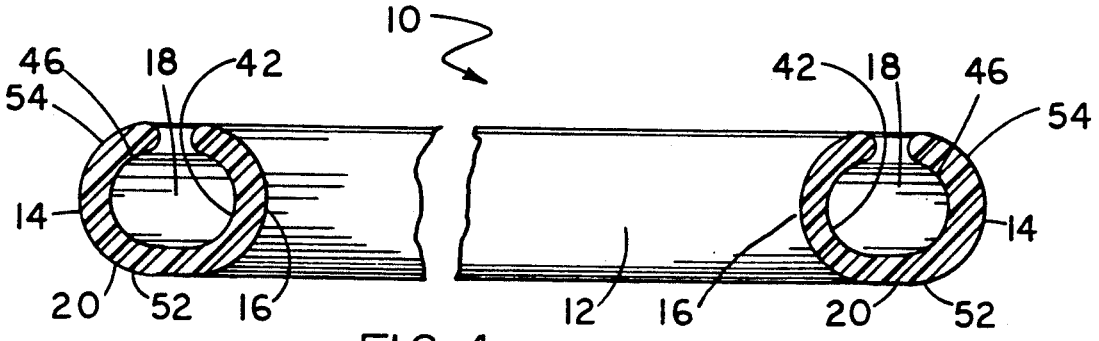
FIG. 4 is a cross-sectional front view of the inventive rim guard, having a vertically curved inner wall and flat bottom surface.

Member 12 may take any of several cross-sectional shapes. As seen in FIG. 2, the cross-sectional profile of the inner surface 42 of inner wall 16 may be vertically rectilinear, because the inner face 44 of rim 24 is usually shaped this way. Yet if the cross-sectional profile of inner face 44 happens to curve in the vertical direction for a particular can 30 design, inner surface 42 of inner wall 16 is preferably made to conform to this curved shape. See FIG. 4. Bottom wall 20 may optionally have a flat lower surface 52, as shown in FIG. 4, or rounded a rounded lower surface 52 as shown in FIG. 2. The cross-sectional profiles of the outer faces 48 of most can rims 24 are vertically convex, and inner surface 46 of outer wall 14 is preferably curved to match this shape.

Figure 5:
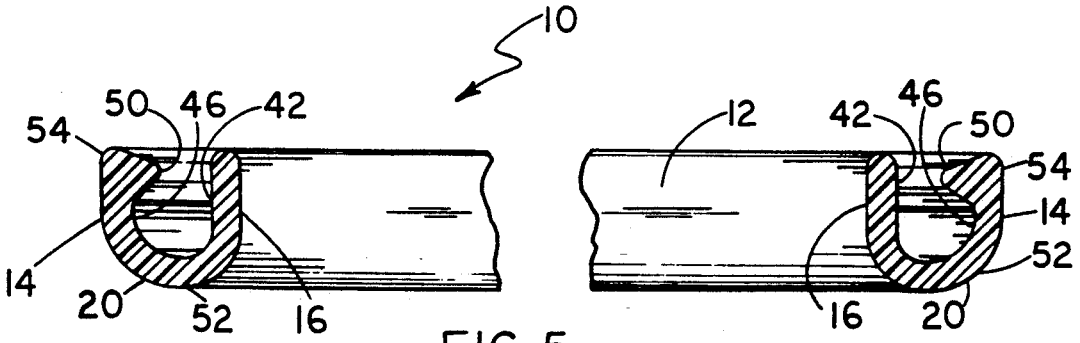
FIG. 5 is a cross-sectional front view of the inventive rim guard, having a vertically straight inner wall and provided with the optional reinforcing lip.

A reinforcing bead of material or lip 50 is preferably provided along the inner surface 46 of outer wall 14 at the upper edge 54. See FIG. 5. The purpose of lip 50 is to increase the strength and resilience of member 12. Rim 24 normally protrudes radially beyond the wall 60 of a can 30. Lip 50 preferably has an inner diameter matching the outer diameter of can wall 60. Thus lip 50 must stretch slightly to snap over rim 24 during member 12 installation. Then lip 50 resiliently contracts to its original diameter, just above rim 24, to hold member 12 in place.

Figure 6:
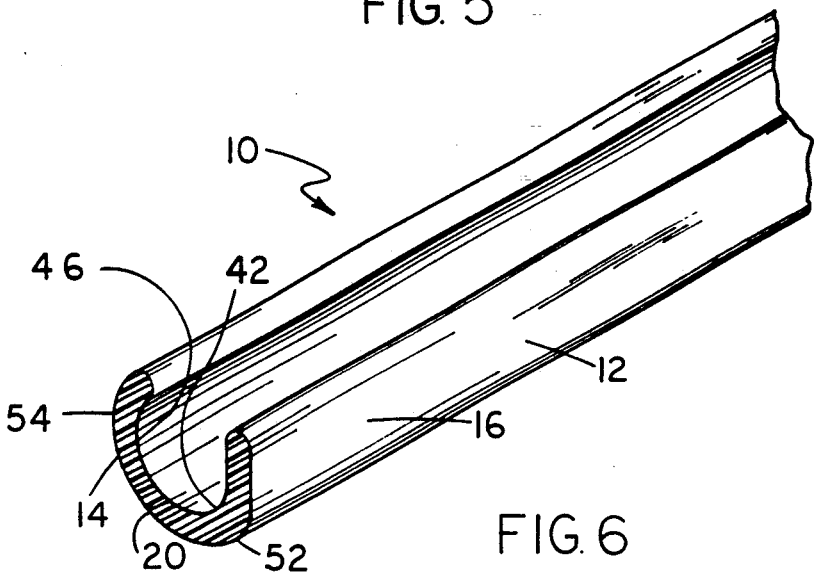
FIG. 6 is a perspective view the flexible strip version of the rim guard, which can be cut and laterally bent to fit a variety of can sizes and shapes.
Figure 5A:
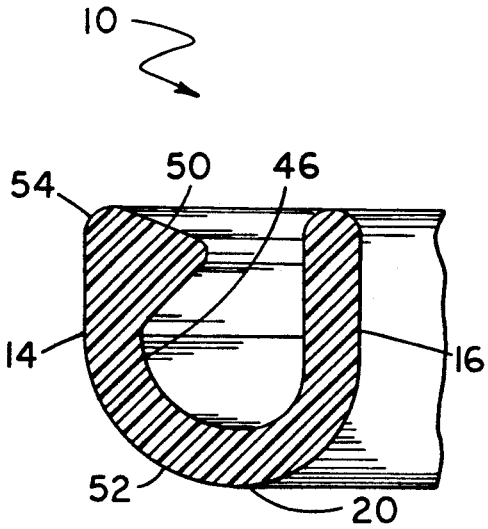
FIG. 5*a* is a cross-sectional side view of the channel member of FIG. 5.

Member 12 may be loop-shaped to conform to the shape of rim 24, which may be circular or rectangular. Alternatively, member 12 may simply be a flexible strip which can be cut and laterally bent to fit any of several can 30 sizes and shapes. See FIG. 6. Member 12 may alternatively be bonded to rim 24 such as with adhesive or, grip rim 24 under tension.

Second Preferred Embodiment

Figure 7:
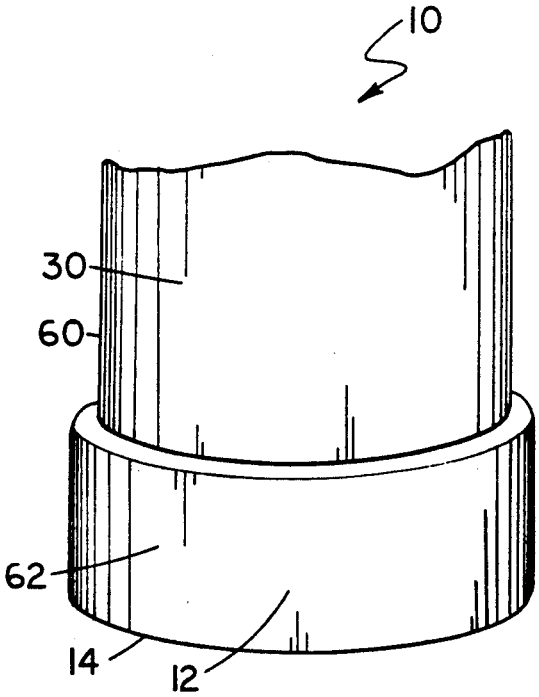
FIG. 7 is a perspective, cut away view of the inventive rim guard of the second embodiment containing a can, the rim guard having the extended outer wall feature displaying a message.

The second preferred embodiment is like the first except that outer wall 14 is extended up wall 60 of can 30 to provide a display area 62 for advertisements. See FIG. 7. Lettering and graphic illustrations can be formed into member 12 material with embossing or coloring techniques well known in the art, or with a marked band attached around wall 14. The extension of wall 60 is intended primarily for displaying add specialties.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An apparatus, comprising:

a can having a can bottom wall and a can side wall with a side wall lower end, and having a lower rim extending downward from said can side wall below said can bottom wall, said lower rim having an inner rim face and an outer rim face, at least one of said rim faces being a protruding rim face extending radially beyond said can wall, and a rim bottom edge extending between said inner and outer rim faces;

a can supporting channel member formed of a resilient material and having first and second side wall portions and a bottom wall portion connecting said first and second side wall portions, for snapping over said lower rim for abutting a can support surface to support said can and for shielding said rim from water deposits on said support surface and for shielding said support surface from any rust particles on said rim, such that said first side wall portion substantially covers said outer rim face, and said second side wall portion substantially covers said inner rim face, and said bottom wall portion substantially covers said rim bottom edge, wherein said side wall portions each have a side wall inner surface; and a lip portion extending from at least one said side wall inner surface, for resiliently snapping over said protruding rim face and contracting above said protruding rim face to help hold said channel member securely on said lower rim, wherein said channel member is formed into a substantially continuous loop.

2. An apparatus according to claim 1, wherein said can has a can wall, and wherein said first side wall portion of said channel member extends upward along said can wall above said rim for providing a surface for displaying a message.

3. An apparatus according to claim 1, wherein said bottom wall portion has a flat lower surface for distributing the weight of said can on a supporting surface.

4. An apparatus according to claim 1, wherein said bottom wall portion has a rounded lower surface for providing a concentrated contact area to maximize friction with a supporting surface.

5. An apparatus according to claim 1, wherein said channel member is a flexible strip which can be cut and laterally bent to fit a variety of said rims.

6. An apparatus according to claim 1, wherein said lip portion extends continuously along said at least one side wall inner surface.

7. An apparatus according to claim 1, wherein said lip portion extends along a limited segment of said at least one side wall inner surface.

8. An apparatus, comprising:

a can having a can bottom wall and a can side wall with a side wall lower end, and having a lower rim extending downward from said can side wall below said can bottom wall, said lower rim having an inner rim face and an outer rim face, at least one of said rim faces being a protruding rim face extending radially beyond said can wall and having a remote end, and a rim bottom edge extending between said inner and outer rim faces;

a can supporting channel member formed of a resilient material and having first and second side wall portions and a bottom wall portion connecting said first and second side wall portions, for snapping over said lower rim for abutting a can support surface to support said can and for shielding said rim from water deposits on said support surface and for shielding said support surface from any rust particles on said rim, such that said first side wall portion substantially covers said outer rim face, and said second side wall portion substantially covers said inner rim face, and said bottom wall portion substantially covers said rim bottom edge, wherein at least one said side wall portion extends toward said can side wall above said protruding rim face, such that said at least one side wall portion reaches a point above said remote end of said protruding rim face which is closer to said can side wall than said remote end of said protruding rim face, for preventing said lower rim and said can side wall from sliding out of said channel member, wherein said channel member is formed into a substantially continuous loop.

9. An apparatus, comprising:

a can supporting channel member adapted for use on a can having a can bottom wall and a can side wall with a side wall lower end, and having a lower rim extending downward from said can side wall below said can bottom wall, said lower rim having an inner rim face and an outer rim face, at least one of said rim faces being a protruding rim face extending radially beyond said can wall, and a rim bottom edge extending between said inner and outer rim faces;

said channel member being formed of a resilient material and having first and second side wall portions and a bottom wall portion connecting said first and second side wall portions, for snapping over said lower rim for abutting a can support surface to support said can and for shielding said rim from water deposits on said support surface and for shielding said support surface from rust particles on said rim, such that said first side wall portion substantially covers said outer rim face, and said second side wall portion substantially covers said inner rim face, and said bottom wall portion substantially covers said rim bottom edge, wherein said side wall portions each have a side wall inner surface; and a lip portion extending from at least one said side wall inner surface, for resiliently snapping over said protruding rim face and contracting above said protruding rim face to help hold said channel member securely on said lower rim, wherein said channel member is formed into a substantially continuous loop.

* * * * *